US009086652B2

(12) United States Patent
Katsuyama

(10) Patent No.: US 9,086,652 B2
(45) Date of Patent: Jul. 21, 2015

(54) IMAGE FORMING APPARATUS

(71) Applicant: Goro Katsuyama, Kanagawa (JP)

(72) Inventor: Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/261,577

(22) Filed: Apr. 25, 2014

(65) Prior Publication Data

US 2014/0334848 A1 Nov. 13, 2014

(30) Foreign Application Priority Data

May 8, 2013 (JP) ..... 2013-098909

(51) Int. Cl.
*G03G 15/08* (2006.01)
*G03G 21/16* (2006.01)

(52) U.S. Cl.
CPC ..... *G03G 15/0875* (2013.01); *G03G 21/1676* (2013.01)

(58) Field of Classification Search
CPC ..... G03G 15/0832; G03G 15/0865; G03G 15/0875; G03G 21/1875
USPC ..... 399/258, 260, 262
See application file for complete search history.

(56) References Cited

U.S. PATENT DOCUMENTS

2007/0077098 A1 4/2007 Katsuyama et al.
2007/0147902 A1 6/2007 Taguchi et al.
2008/0310884 A1 12/2008 Matsumoto et al.
2009/0009829 A1 1/2009 Katsuyama
2009/0074494 A1 3/2009 Katsuyama et al.
2009/0129811 A1 5/2009 Katsuyama et al.
2009/0324298 A1 12/2009 Katsuyama et al.
2011/0002713 A1 1/2011 Taguchi et al.
2011/0008075 A1 1/2011 Taguchi et al.
2011/0181903 A1 7/2011 Katsuyama et al.
2011/0262189 A1* 10/2011 Saito ..... 399/258
2011/0286771 A1 11/2011 Taguchi et al.
2011/0298873 A1 12/2011 Katsuyama et al.
2012/0141171 A1 6/2012 Taguchi et al.

FOREIGN PATENT DOCUMENTS

JP 2005-300911 10/2005
JP 2007-148320 6/2007

* cited by examiner

*Primary Examiner* — Erika J Villaluna
(74) *Attorney, Agent, or Firm* — Oblon, McClelland, Maier & Neustadt, L.L.P.

(57) ABSTRACT

An image forming apparatus includes an insertion entrance through which a toner container is inserted, and an entrance peripheral wall surrounding the insertion entrance and including an upper wall and a projecting bottom wall projecting beyond the upper wall to an upstream side in an insertion direction in which the toner container is inserted. The toner container includes a toner outlet in a substantially center portion of a bottom of the toner container in a width direction perpendicular to the insertion direction and a shutter to open and close the toner outlet. A recess recessed in the insertion direction is provided in a center portion of the projecting bottom wall in the width direction, and the recess in the projecting bottom wall is longer than the shutter in the width direction.

7 Claims, 14 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2013-098909, filed on May 8, 2013, in the Japan Patent Office, the entire disclosure of which is hereby incorporated by reference herein.

BACKGROUND OF THE INVENTION

1. Technical Field

Embodiments of the present invention generally relate to an image forming apparatus, such as a copier, a printer, a facsimile machine, a plotter, or a multifunction machine (so-called multifunction peripheral or MFP) having at least two of coping, printing, facsimile transmission, plotting, and scanning capabilities and further relate to an image forming apparatus including a mount in a body thereof to which a toner container is removably installed.

2. Description of the Background Art

Generally, electrophotographic image forming apparatuses such as copiers, printers, facsimile machines, or multifunction machines (MFPs) include a latent image bearer such as a photoreceptor drum or a photosensitive belt, a developing device, and the like, and laser beams are directed onto the surface of the latent image bearer, thereby forming electrostatic latent images according to image data. The electrostatic latent image is developed with toner by the developing device.

Image forming apparatuses are typically provided with a replaceable toner container or a replaceable toner cartridge, in which a toner container and other image forming components are integrated, to supply toner therefrom to the developing device, thereby compensating for the toner consumption. As toner therein is consumed, such toner containers become empty and replaced. It is preferred to increase the toner containing capacity thereof to extend the operational life of the toner container. The increase in the toner containing capacity, however, results in the increase in size of the toner container, and the image forming apparatus incorporating the toner container becomes bulkier. Therefore, there is a need for increasing toner containing capacity and reducing the size of the toner container (useless space is smaller).

Various configurations are proposed for toner containers. For example, as proposed in JP-2005-300911-A, there are toner containers that are substantially rectangular parallelepiped, long in a vertical direction and short in a depth direction, and are installed in image forming apparatuses (apparatus body in particular) in the vertical direction. Additionally, there are rotatable toner containers, as proposed in JP-2007-148320-A, having a handle on a proximal side.

The toner container proposed in JP-2005-300911-A is provided a toner containing body inserted downward therein by opening a door of the toner container. An adapter and a mouthpiece member are provided at a lower end of the toner containing body, and a plug set in the mouthpiece member is opened in conjunction with closing of the door. Thus, a toner outlet (i.e., a toner discharge port) is opened to enable supply of toner.

The toner container proposed in JP-2007-148320-A is cylindrical. In this case, a front cover of the apparatus body is opened to the proximal side to expose the mount therein. Then, one end of the toner container is pushed in from the proximal side. Accordingly, the handle is provided to a container body for users to grip in installation and removal of the toner container.

SUMMARY OF THE INVENTION

In view of the foregoing, one embodiment of the present invention provides an image forming apparatus that includes an insertion entrance through which a toner container is inserted and an entrance peripheral wall surrounding the insertion entrance and including an upper wall and a projecting bottom wall projecting beyond the upper wall to an upstream side in an insertion direction in which the toner container is inserted. The toner container includes a toner outlet in a substantially center portion of a bottom of the toner container in a width direction perpendicular to the insertion direction and a shutter to open and close the toner outlet. A recess is provided in a center portion of the projecting bottom wall in the width direction and recessed from the upstream side to a downstream side in the insertion direction. The recess in the projecting bottom wall is longer than the shutter at the bottom of the toner container in the width direction.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
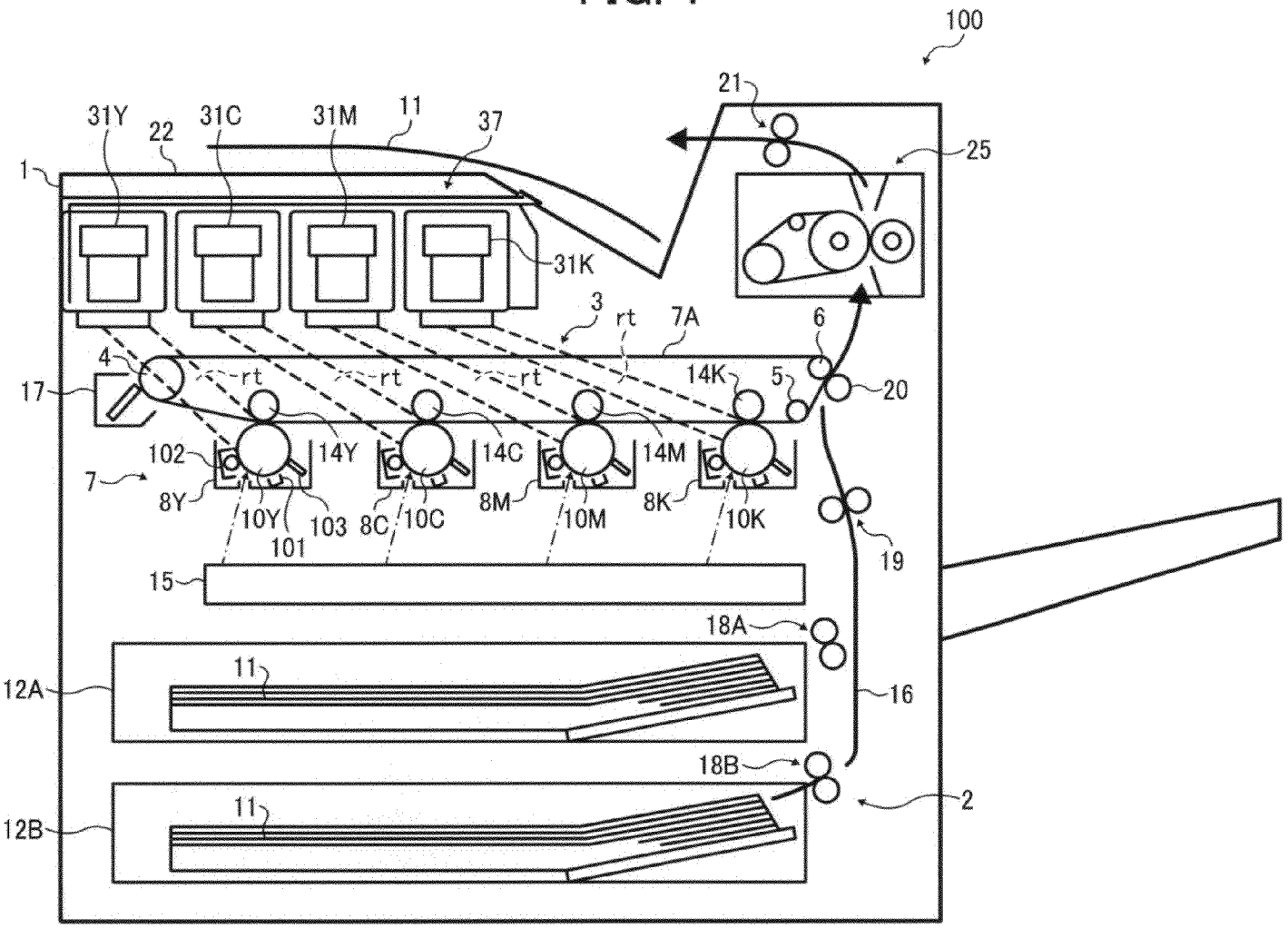
FIG. 1 is a schematic view of an image forming apparatus including a container mount in which a toner container according to an embodiment is installed.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The inventor of the present invention recognizes that, in the case of a toner container employing a toner containing body including a plug that is disengaged from a mouthpiece member of the toner containing body simultaneously with installation of the toner container, the possibility of a malfunction is high when the position is deviated.

Further, according to understanding of the inventor of the present invention, in the case of a toner container including a handle and produced by blow molding, toner tends to accumulate on the back side of the handle, thus increasing the amount of toner that is not discharged.

In a case in which the toner container including the handle is moved horizontally from an insertion entrance to a distal side to the mount with the bottom of the toner container mounted on the bottom of the insertion entrance, it is preferred that the toner container moves smoothly even if the bottom thereof is in contact with the bottom of the insertion entrance. Additionally, the toner outlet in a lower portion of the toner container should be aligned with a toner supply channel communicating with the developing device. Further, this configuration requires prevention of unintended opening of the shutter or the plug to open and close the toner outlet during insertion of the toner container into the insertion entrance.

In view of the foregoing, an aim of the embodiment described below is to provide an image forming apparatus capable of smooth installation and removal of a toner container in and from a mount therefor, and, in particular, capable of inhibiting a component on the bottom of the toner container from hitting the bottom of the insertion entrance and inhibiting malfunction caused thereby.

Referring now to the drawings, wherein like reference numerals designate identical or corresponding parts throughout the several views thereof, and particularly to FIG. 1, an entire configuration of an image forming apparatus according to an embodiment is described below.

FIG. 1 is a schematic view of an image forming apparatus 100 that in the present embodiment is an electrophotographic printer, for example.

The image forming apparatus 100 includes an apparatus body 1, a sheet feeder 2 disposed in a lower portion of the apparatus body 1, and an image forming assembly 3 disposed above the apparatus body 1. The sheet feeder 2 includes sheet trays 12A and 12B to contain multiply sheets 11 of recording media. The image forming assembly 3 includes image forming units 8Y, 8M, 8C, and 8K respectively provided with photoreceptor drums 10Y, 10M, 10C, and 10K as image bearers and an intermediate transfer unit 7. It is to be noted that the suffixes Y, M, C, and K attached to each reference numeral indicate only that components indicated thereby are used for forming yellow, magenta, cyan, and black images, respectively, and hereinafter may be omitted when color discrimination is not necessary. The intermediate transfer unit 7 includes an intermediate transfer belt 7A, serving an intermediate transfer member, looped around multiple rollers 4, 5, and 6.

The image forming assembly 3 includes a writing device 15 to write image data on the respective photoreceptor drums 10 and a fixing device 25 to fix a toner image formed on the sheet 11. Additionally, a conveyance channel 16 extends from the sheet feeder 2 to the fixing device 25, and conveyance rollers to transport the sheets 11 are provided thereto.

In the image forming unit 8, a charging device 101, a developing device 102, and a cleaning device 103 are provided around the photoreceptor drum 10, and these components are united in a process cartridge (i.e., a modular unit) removably installed in the apparatus body 1. The developing devices 102 contain yellow, cyan, magenta, and black toners, respectively. As the amount of toner contained therein decreases, toner of corresponding color is supplied to the developing device 102 through a toner conveyance channel rt from a toner outlet 50 (shown in FIG. 6A) of a toner container 31 (i.e., a toner cartridge) disposed in an upper portion of the apparatus body 1.

The intermediate transfer belt 7A faces the respective photoreceptor drums 10 and rotates counterclockwise in FIG. 1. Inside the loop of the intermediate transfer belt 7A, primary-transfer rollers 14Y, 14C, 14M, and 14K, serving as primary-transfer members, are provided facing the respective photoreceptor drums 10. The primary-transfer rollers 14 receive transfer biases for primary transfer. At a position facing the roller 4, a belt cleaning device 17 is provided. The intermediate transfer belt 7A, the rollers 4, 5, and 6, the primary-transfer rollers 14, and the belt cleaning device 17 are united together as a modular unit removably installed in the apparatus body 1.

Additionally, a secondary-transfer roller 20 is disposed in contact with the intermediate transfer belt 7A at a position facing the roller 6. The secondary-transfer roller 20 receives a secondary-transfer bias. The secondary-transfer roller 20 and a part of the intermediate transfer belt 7A face the secondary-transfer roller 20.

The writing device 15 directs laser beams that are modulated optically onto the surfaces of the photoreceptor drums 10, thus forming electrostatic latent images for the respective colors thereon. The writing device 15 is disposed beneath the image forming units 8 and configured to direct the laser beams upward.

When image formation is started, the photoreceptor drums 10 in the respective image forming units 8 are rotated clockwise in FIG. 1, and the changing devices 101 uniformly charge the surfaces of the photoreceptor drums 10 to a predetermined polarity. Then, the writing device 15 forms the electrostatic latent image on the charged surface of the photoreceptor drum 10. More specifically, the writing device 15 directs the laser beams according to single color data, namely, yellow, cyan, magenta, and black color data decomposed from full-color image data to the surfaces of the photoreceptor drums 10. The electrostatic latent image is then developed with toner while passing between the photoreceptor drum 10 and the developing device 102.

When the intermediate transfer belt 7A is driven counterclockwise by a driving unit, the image forming unit 8Y including the developing device 102 containing yellow toner, which is extreme upstream among the four image forming units 8 in the direction in which the intermediate transfer belt 7A moves, is driven. Then, the primary-transfer roller 14Y transfers the yellow toner image onto the intermediate transfer belt 7A. The primary-transfer rollers 14M, 14C, and 14K transfer the magenta, cyan, and black toner images respectively and superimpose one on another on the yellow toner image. Thus, the intermediate transfer belt 7A bears a full-color toner image on its surface.

Subsequently, the cleaning devices 103 remove toner remaining on the respective photoreceptor drums 10, and dischargers remove potentials remaining on the surfaces of the respective photoreceptor drums 10 as a preparation for subsequent image formation.

Meanwhile, the sheet 11 is fed from the sheet feeder 2 to the conveyance channel 16 as a feed roller 18A or 18B rotates. Then, a pair of registration rollers 19, positioned upstream from the secondary-transfer roller 20 in the direction of sheet conveyance, forwards the sheet 11 to a secondary-transfer nip between the secondary-transfer roller 20 and the intermediate transfer belt 7A, timed to coincide with the multicolor toner image (superimposed single-color toner images) formed on the intermediate transfer belt 7A. At that time, the transfer bias voltage whose polarity is opposite that of the toner image on the intermediate transfer belt 7A is applied to the intermediate transfer belt 7A, and the superimposed toner images are transferred at a time onto the sheet 11.

Subsequently, the sheet 11 is transported to the fixing device 25, where the toner image is fixed on the sheet 11 with heat and pressure. Then the sheet 11 is transported to a pair of discharge rollers 21 at the end of a sheet conveyance route and discharged onto a discharge tray 22 provided on an upper face of the apparatus body 1. After the toner image is transferred therefrom, untransferred toner remaining on the intermediate transfer belt 7A is removed by the belt cleaning device 17.

Figure 2:
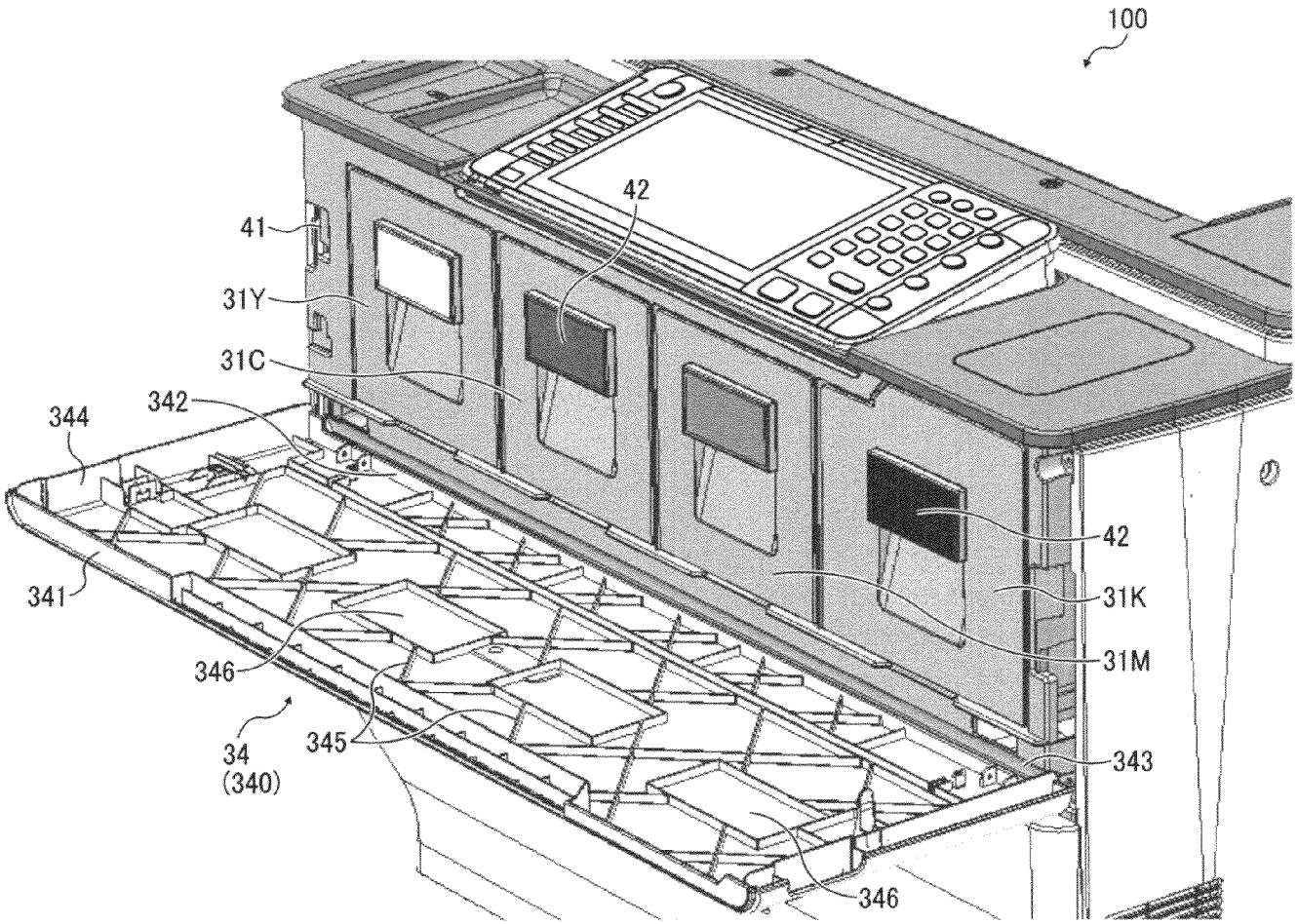
FIG. 2 is a perspective front view of the image forming apparatus shown in FIG. 1, in which a cover is open.
Figure 3:
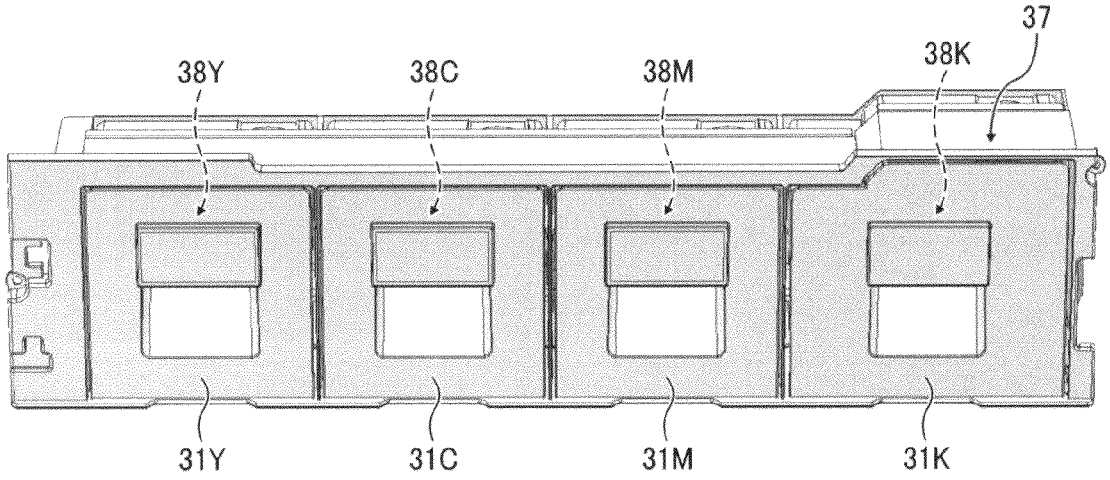
FIG. 3 is an enlarged front view of the image forming apparatus shown in FIG. 1.
Figure 4:
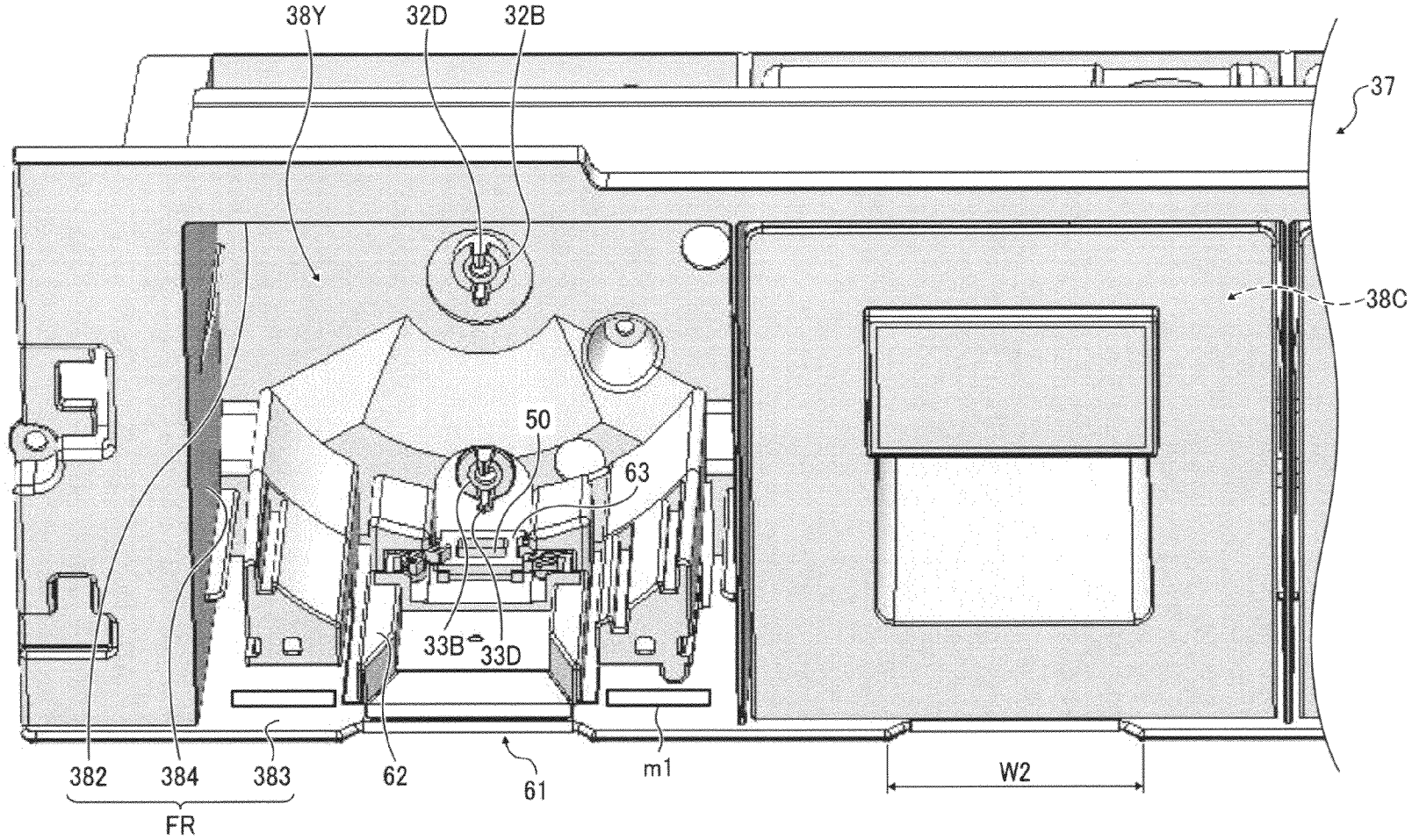
FIG. 4 is an enlarged front view of the container mount of the image forming apparatus shown in FIG. 1, from which one of toner containers is removed.

Next, a toner supply unit 37 of the image forming apparatus 100 is described below. As shown in FIGS. 2 through 4, the toner supply unit 37 is in the upper portion of the apparatus body 1 and on a proximal side of the apparatus body 1.

It is to be noted that, in the description below, the term "proximal side" means the front side of the apparatus body 1, which is the upstream side (trailing side) in the direction in which the toner container 31 is inserted into the apparatus body 1 (hereinafter "insertion direction A"), and the term "distal" means the rear side of the apparatus body 1, which is the downstream side (leading side) in the insertion direction.

The toner supply unit 37 includes container mounts 38Y, 38M, 38C, and 38K arranged in parallel corresponding to the respective colors. The toner containers 31Y, 31C, 31M, and 31K are respectively installed in the container mounts 38Y, 38C, 38M, and 38K.

Figure 8:
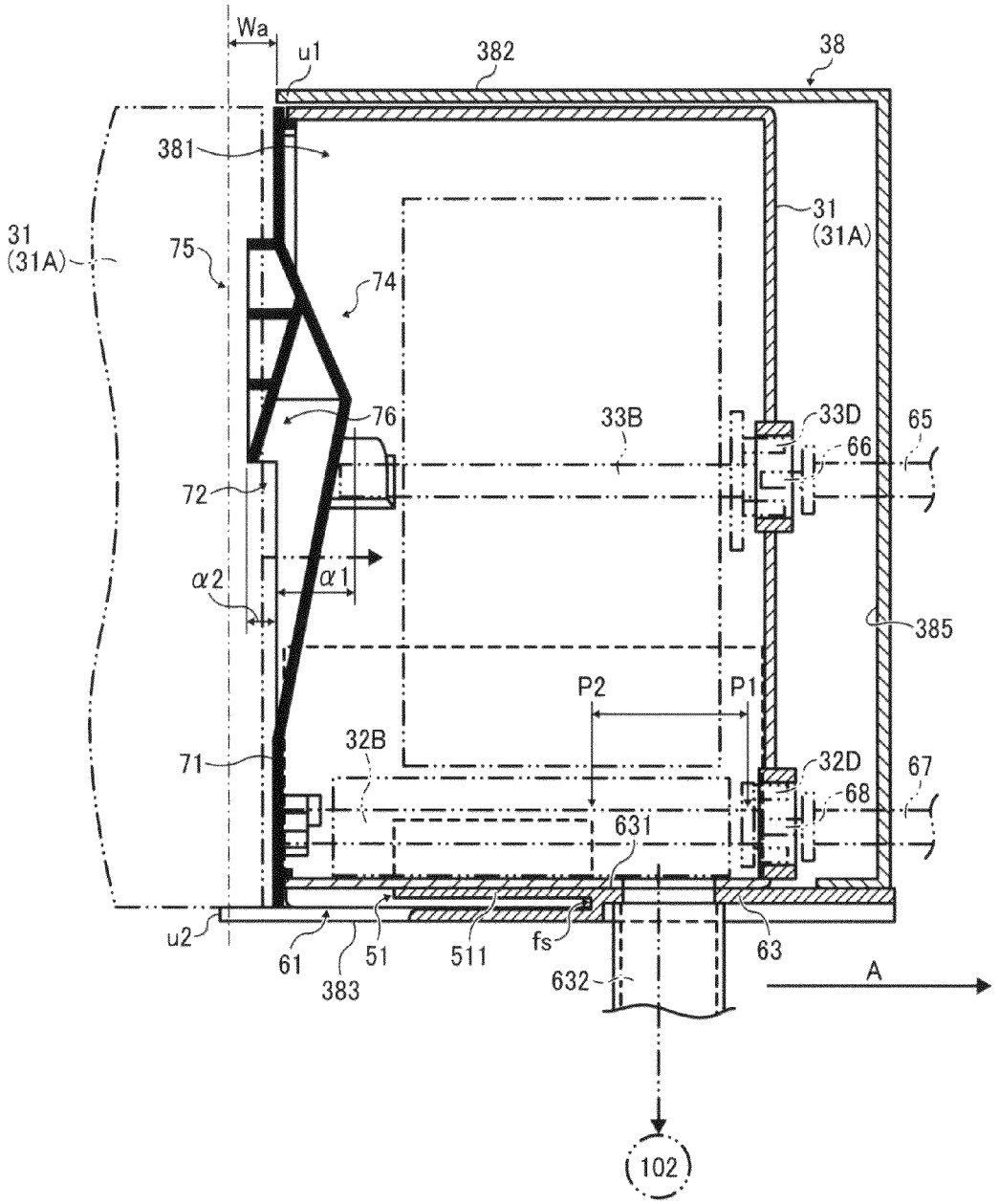
FIG. 8 is a vertical cross-sectional view of the container mount and the toner container shown in FIG. 6A.

As shown in FIG. 8, the container mount 38 provided in the apparatus body 1, to which the toner container 31 is installed, includes an insertion entrance 381 into which the toner container 31 is inserted, an entrance peripheral wall FR surrounding the insertion entrance 381, and a rear wall 385 on a distal side of the apparatus body 1. The entrance peripheral wall FR surrounding the insertion entrance 381 is constructed of an upper wall 382, a bottom wall 383, and lateral side walls 384.

As shown in FIG. 8, in a state in which the toner container 31 is installed in the container mount 38, a front wall 71 (a proximal face thereof in particular) of the toner container 31 is flush with a peripheral wall end u1 of the upper wall 382. Additionally, the bottom wall 383 (in particular, a peripheral wall end u2 thereof), serving as a projecting bottom wall, projects more than the upper wall 382 to the proximal side (upstream side in the direction of insertion of the toner container 31 indicated by arrow A in FIG. 8). In FIG. 8, the bottom wall 383 projects by a length Wa beyond the upper wall 382. The peripheral wall end u2 of the bottom wall 383, which projects beyond the upper wall 382 to the proximal side (to the left in FIG. 8) by the length Wa, can be used conveniently as a temporary mount on which a leading end of the toner container 31 in the insertion direction is placed during insertion of the toner container 31 into the insertion entrance 381.

Further, referring to FIGS. 9A and 9B, a substantially center portion of the bottom wall 383 in a direction (i.e., width direction) perpendicular to the insertion direction A is recessed by a predetermined amount to the downstream side in the direction indicated by arrow A (hereinafter "insertion direction A"). That is, a recess 61 is provided. It is to be noted that "substantially center portion" here means a position that is not extremely deviated to one side.

In the width direction perpendicular to the insertion direction A, the recess 61 of the bottom wall 383 is cut away a length W2 (shown in FIG. 9A) longer than a length W1 (shown in FIG. 6A) of a shutter 51 provided to a bottom of the toner container 31.

Since the substantially center portion of the bottom wall 383 is thus cut out, forming the recess 61, when the bottom of the toner container 31 on the leading side in the insertion direction (i.e., leading bottom) is placed on the bottom wall 383 and the position thereof is aligned, the shutter 51 provided at the leading bottom can be inhibited from hitting on the bottom wall 383 that is the projecting bottom wall.

Further, this configuration can reduce the risk that the shutter 51 hits against the projecting portion of the bottom wall 383 when the toner container 31 being slightly inclined is about to enter the insertion entrance 381. This is effective in preventing the shutter 51 from opening before completion of insertion of the toner container 31.

On the bottom wall 383 continuous with the recess 61, an color indication ml for indicating the color of toner contained in the toner container 31 to be inserted into the insertion entrance 381 (shown in FIG. 4) is provided. For example, a seal colored in that color is bonded to the color indication ml. Thus, the color of toner containing in the toner container 31 to be inserted into the container mount 38 is indicated on the bottom wall 383 that is easily observable. Providing the color indication near the recess 61 is effective in inhibiting insertion of the toner container 31 containing wrong color toner into the container mount 38.

Figure 9B:
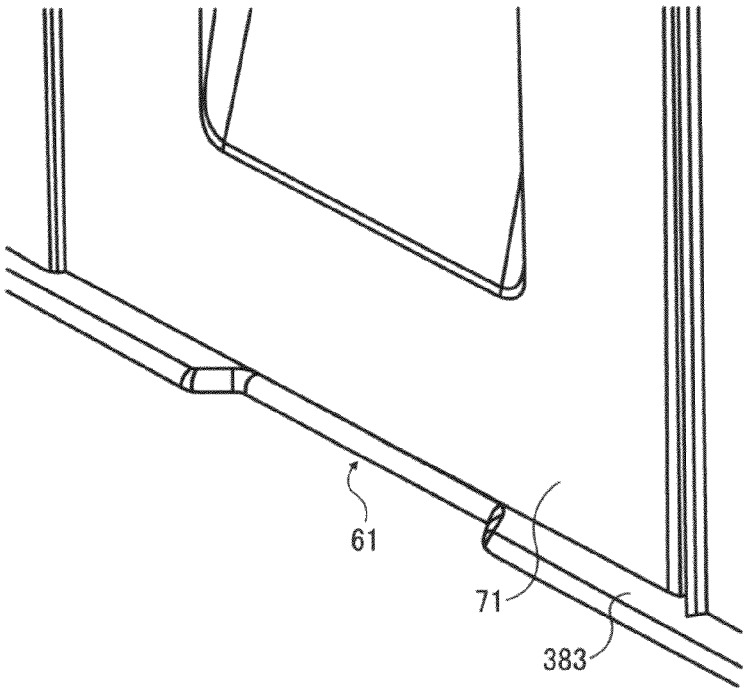
FIG. 9B is a partial perspective view of the container mount in which the toner container is installed.
Figure 9A:
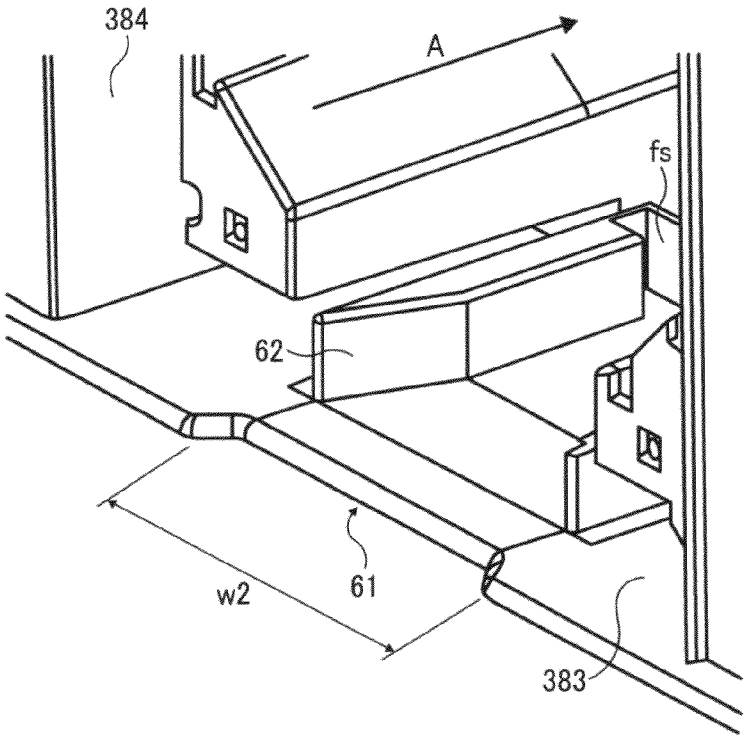
FIG. 9A is a partial perspective view of the container mount from which the toner container is removed.

As shown in FIGS. 4, 9A, and 9B, further, a pair of projecting rails 62 is provided on the bottom wall 383, on the distal side of the recess 61 in the center portion in the direction perpendicular to the insertion direction A. The projecting rails 62 are for guiding the toner container 31 in the insertion direction A. Yet further, a table portion 63 provided with a stopper face fs is provided on the distal side of the projecting rails 62. A groove 311 (shown in FIGS. 6A and 6B) faced down is provided on a bottom wall of a container body 31A, and the pair of projecting rails 62 guides the groove 311 to the distal side to a proper position. The stopper face fs is on a wall of the table portion 63 facing the proximal side. The stopper face fs abuts against the shutter 51 (shown in FIG. 6A) on the bottom of the container body 31A, thereby switching the shutter 51 from a closing position P1 (shown in FIG. 6B) to an open position P2 (shown in FIG. 6A).

Referring to FIGS. 2 and 3, a rectangular cover 34 is pivotably supported in the upper portion on the proximal side of the apparatus body 1 to cover and expose the toner supply unit 37. The cover 34 includes an upper end 341 that is a rotary end and a lower end 342 that is pivoting end pivotably supported by the apparatus body 1 via a hinge 343. The cover 34 opens and closes relative to the toner supply unit 37 by rotating around the hinge 343. The cover 34 can be kept closed by a lock device 41 employing magnetic force. When the cover 34 is opened against the magnetic force, the upper end 341 swings around the hinge 343 to the proximal side, and the cover 34 can be kept at a full open position as shown in FIG. 2.

It is to be noted that the cover 34 includes a peripheral rib 344 that is bent from a cover body 340 and extends to the inner side, that is, into the apparatus body 1. With the peripheral rib 344, the cover 34 is shaped like a thick plate projecting by the length Wa beyond the front wall of the apparatus body 1, and the rigidity thereof can be enhanced. Further, multiple auxiliary ribs 345 arranged in a mesh are provided on an inner face of the cover body 340, inside the peripheral rib 344 to reinforce the cover 34 together with the peripheral rib 344. The inner face of the cover body 340 is further provided with four planar portions 346 from which the auxiliary ribs 345 are eliminated to avoid interferences with color indication plates 42 (shown in FIG. 5A) of handles 72 at extreme ends of the front walls 71 of the toner containers 31Y, 31C, 31M, and 31K.

The toner containers 31 are described in further detail below.

Figure 7A:
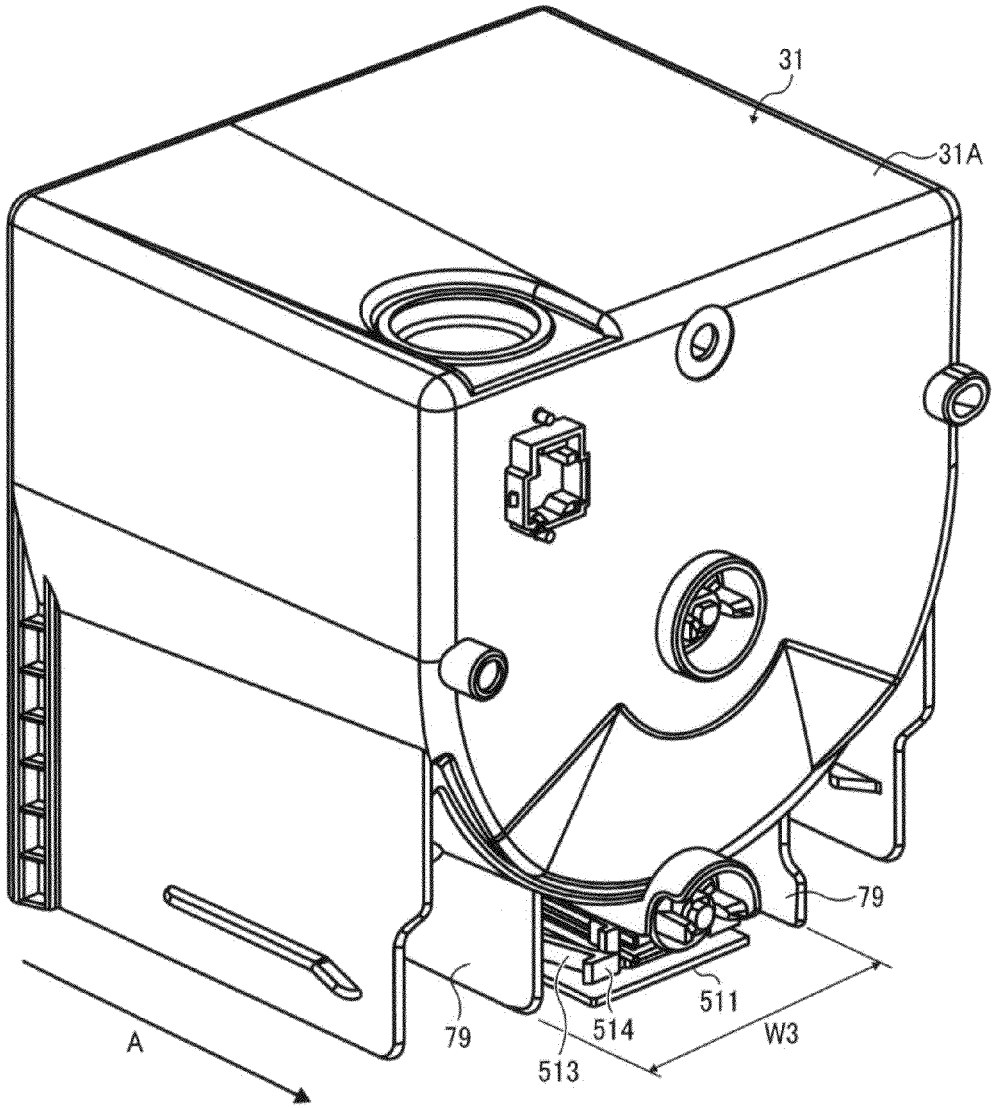
FIG. 7A is a perspective view of the toner container shown in FIGS. 6A and 6B as viewed from a rear side obliquely.
Figure 7B:
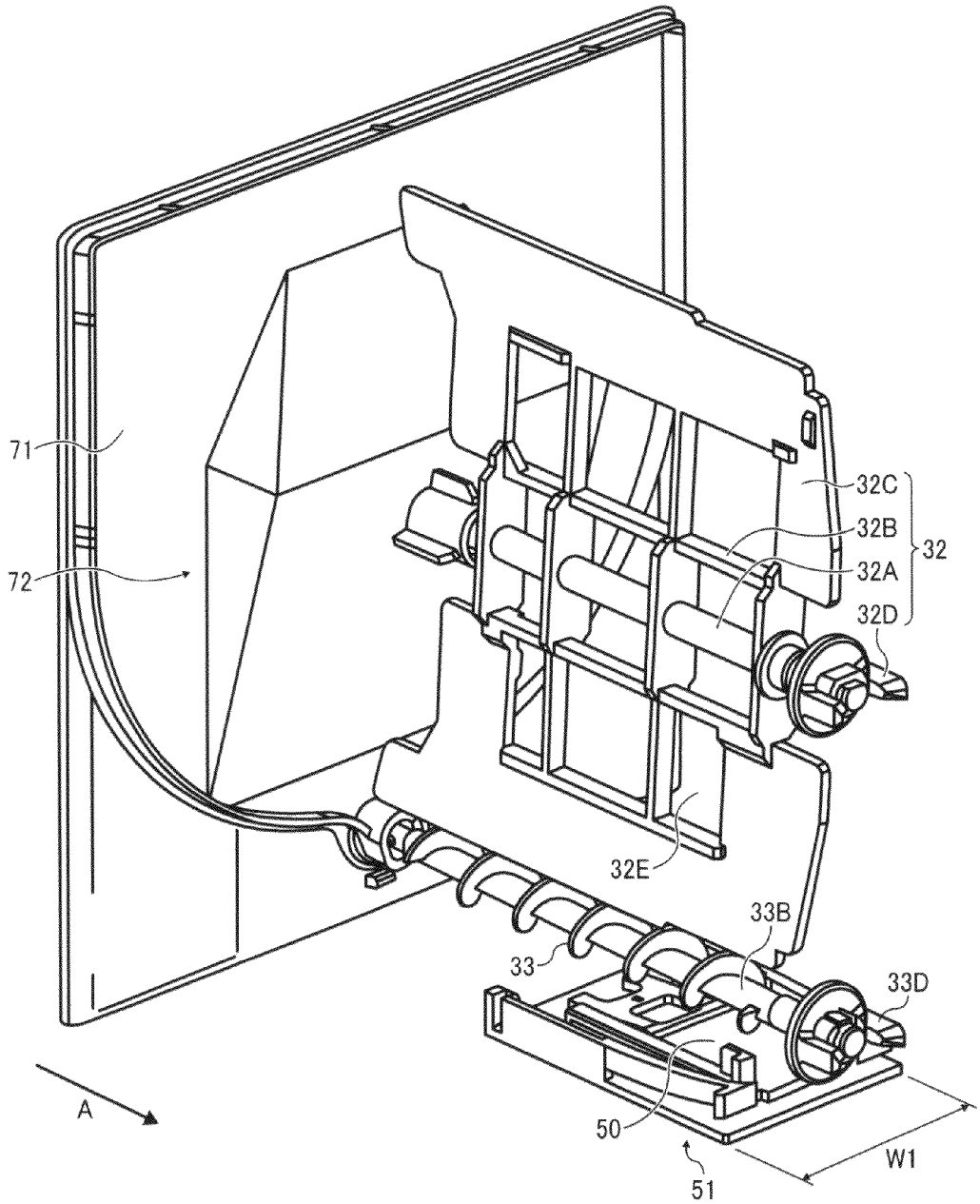
FIG. 7B is a perspective view of a planar agitator in the toner container shown in FIG. 7A.

Referring to FIGS. 7A and 7B, inside the container body 31A, serving a toner containing portion to contain toner, of the toner container 31, a conveying screw 33 and a rotatable agitator 32.

The toner container 31 is shaped like a box. On the front wall 71 on the upstream side in the insertion direction A, a handle 72 is provided so that users can hold the toner container 31 easily.

In the configuration shown in the drawings, the handle 72 is prismatic with projecting portions 74 and 75 projecting from the front wall (on the proximal side) to both sides in the depth direction (proximal and distal sides or outer and inner sides) of the container body 31A. The container body 31A is short in the depth direction, and the projecting portions 74 and 75 projecting from the front wall of the container body 31A form a lateral prism. Accordingly, the handle 72 with enhanced rigidity can be disposed on the front wall 71.

Figure 10A:
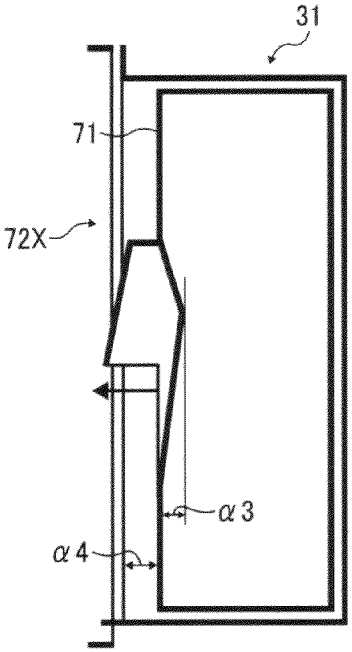
FIG. 10A is a vertical cross-sectional view of a toner container as a comparative example.
Figure 10B:
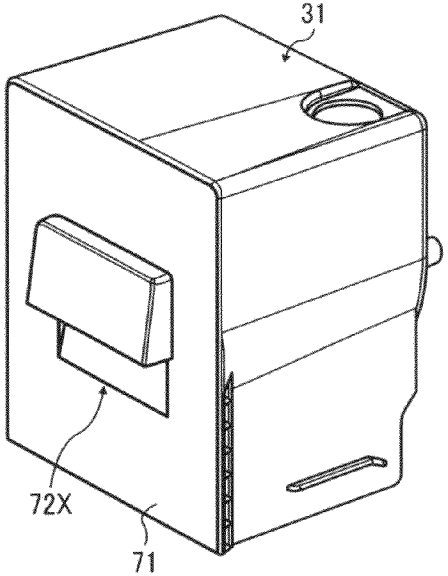
FIG. 10B is a perspective front view of the toner container shown in FIG. 10A.
Figure 10C:
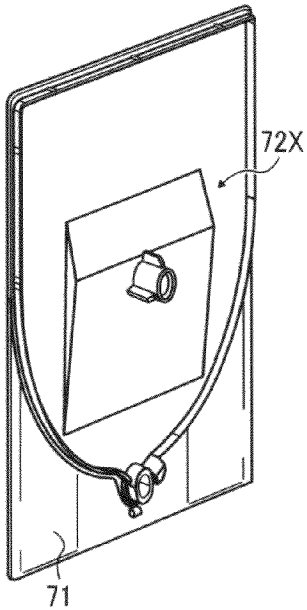
FIG. 10C is a perspective view of an inner side of a front wall of the comparative toner container.
Figure 10D:
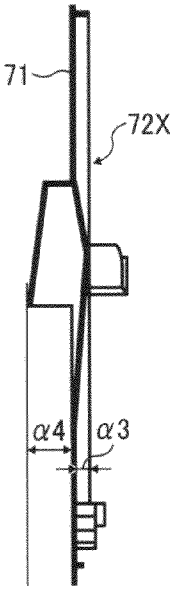
FIG. 10D is a cross-sectional view of the front wall shown in FIG. 10C.
Figure 11A:
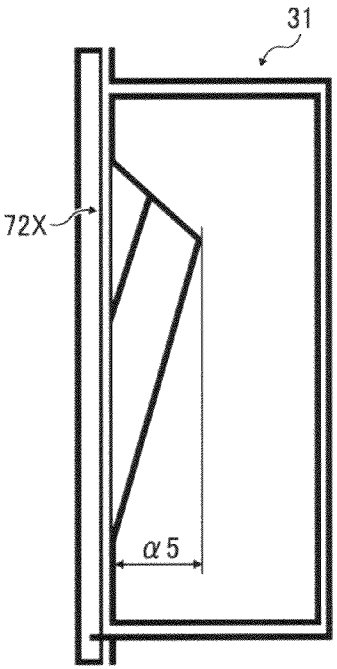
FIG. 11A is a vertical cross-sectional view of a toner container as another comparative example.
Figure 11B:
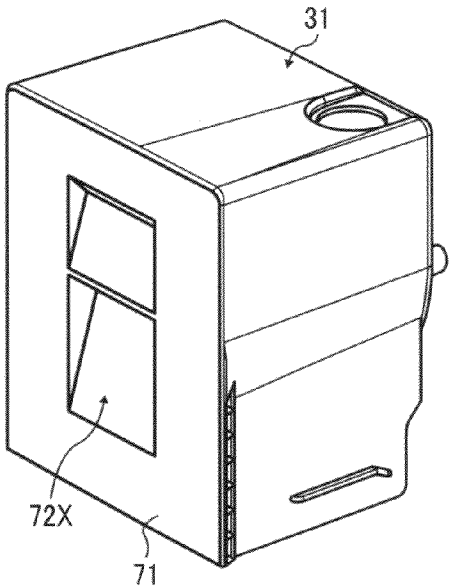
FIG. 11B is a perspective front view of the toner container shown in FIG. 11A.
Figure 11C:
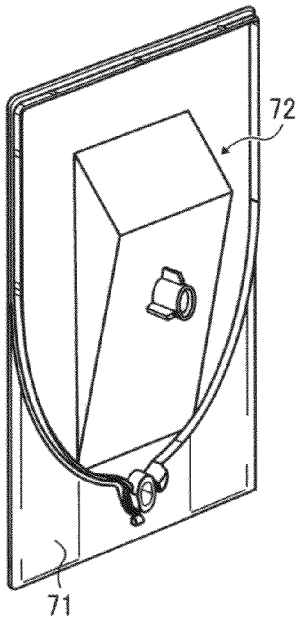
FIG. 11C is a perspective view of an inner side of a front wall of the comparative toner container.
Figure 11D:
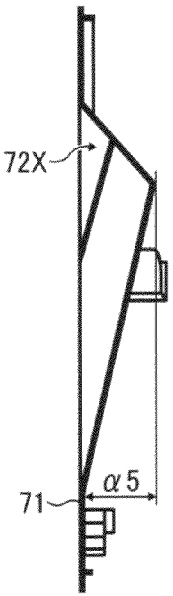
FIG. 11D is a cross-sectional view of the front wall shown in FIG. 11C.

Additionally, as shown in FIGS. 5A through 5D, a proximal end of a finger hook face 76 of the handle 72 is positioned upstream from a proximal end of the front wall 71, and a projecting amount $\alpha$1 to the outer side of the toner container 31 (proximal side) is smaller than a projecting amount $\alpha$2 by which the handle 72 projects inward (to the distal side). Although the capacity of the toner container 31 is reduced with the inward projecting handle 72, the inward projecting amount a2 can be smaller by projecting the proximal end of the finger hook face 76 to the proximal side, thus increasing the capacity of the toner container 31. FIGS. 10A, 10B, 10C, and 10D illustrate a handle 72X as a comparative example. In a configuration in which a projecting amount a3 by which the inner projecting portion 74 projects inward is reduced as shown in FIGS. 10A through 10C, to secure a sufficient depth of the handle 72X for a finger to enter, increases in an outward projecting amount a4 is unavoidable. As a result, the front wall 71 is shifted to the distal side, and the capacity of the toner container 31 decreases. FIGS. 11A through 11D illustrate another comparative example in which the outward projecting amount $\alpha$4 is reduced to zero. In this case, a projecting amount $\alpha$5 of the inner projecting portion 74 increases, and the capacity of the toner container 31 (container body 31A in particular) decreases.

Figure 5A:
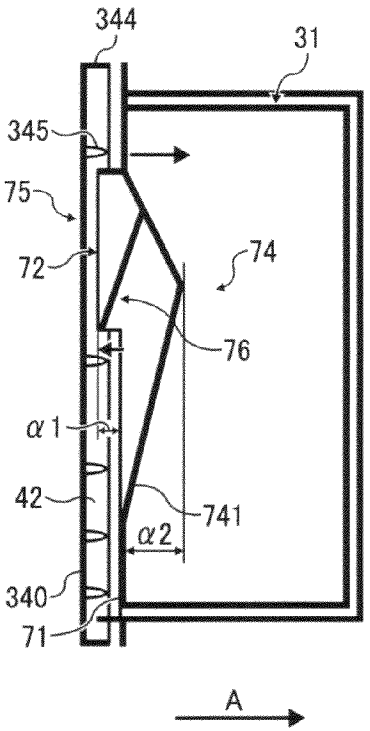
FIG. 5A is a vertical cross-sectional view of the toner container of the image forming apparatus shown in FIG. 1.
Figure 5B:
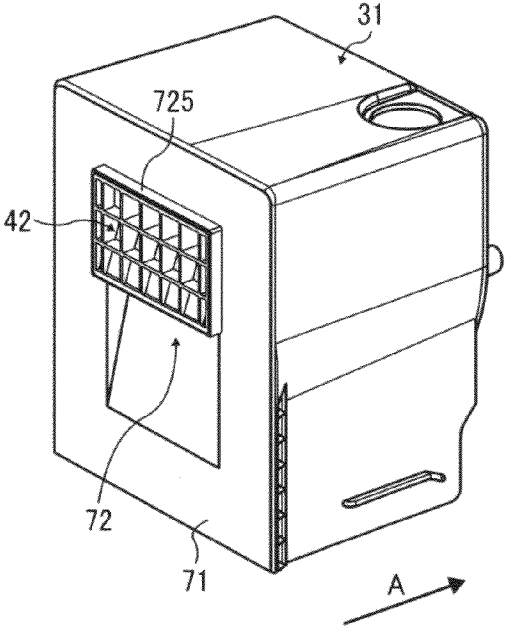
FIG. 5B is a perspective view of the toner container shown in FIG. 5A, as viewed from a front side obliquely.
Figure 5C:
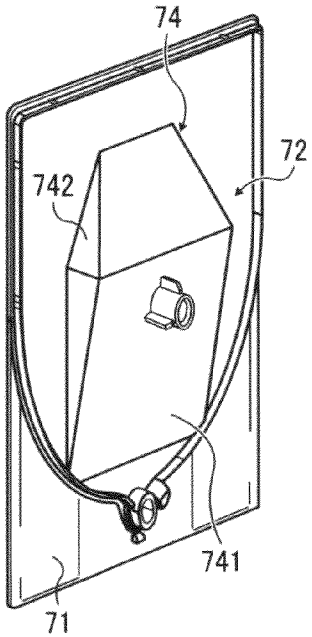
FIG. 5C is a perspective view of an inner side of a front wall of the toner container.
Figure 5D:
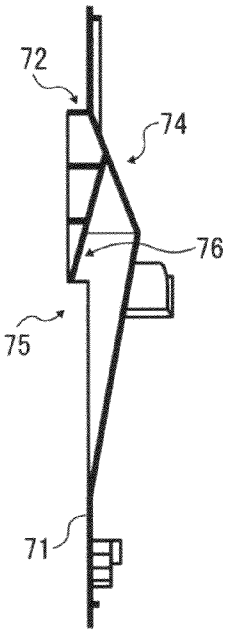
FIG. 5D is a cross-sectional view of the front wall of the toner container.

In the handle 72 shown in FIGS. 5A and 5C, the finger hook face 76 and a lower portion 741 projecting inward are sloped, and the slope is relatively sharp and, for example, an angle greater than 45 degrees relative to a horizontal face. When the projecting portion 75, projecting outward (to the proximal side) and including the finger hook face 76, and the lower portion 741 of the projecting portion 74 projecting inward are thus sloped, monolithic molding can be possible by obliquely sliding a mold. Consequently, component cost can be reduced. Additionally, inclining the finger hook face 76 at a sharp slope is advantageous since it can make it easier to rest a human finger thereon, thereby facilitating pulling out the toner container 31, and the depth (amount of projecting inward) of the handle 72 can be reduced, thereby increasing the capacity of the toner container 31.

Figure 12C:
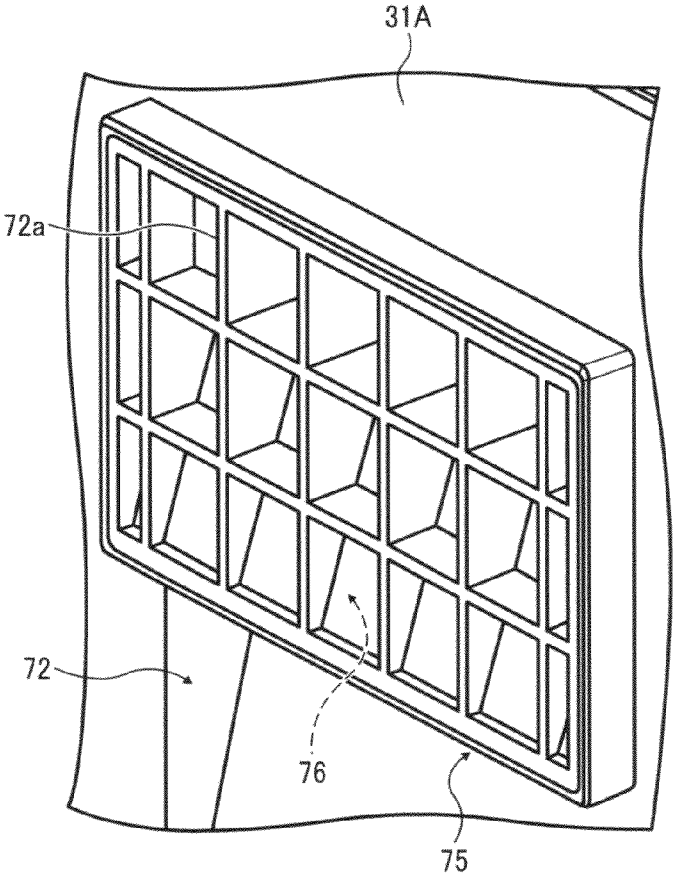
FIG. 12C is an enlarged view of the bonding mount shown in FIG. 12B.
Figure 12B:
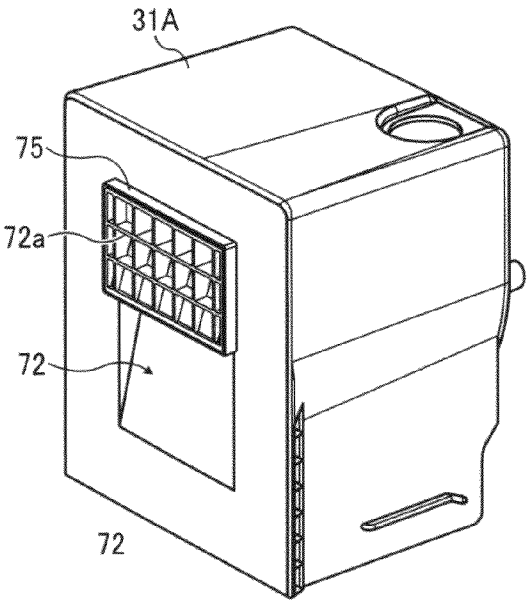
FIG. 12B illustrates a bonding mount to which the color indicator shown in FIG. 12A is bonded.
Figure 12A:
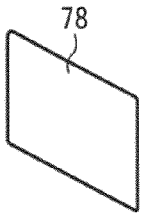
FIG. 12A is a perspective view of a color indicator bonded to the toner container shown in FIG. 5B.

As shown in FIGS. 12A though 12C, the handle 72 further includes multiple front side ribs 72*a*, and the front side ribs 72*a* together serve as a decal bonding mount to which a decal 78 for toner color indication is bonded. For example, the decal 78 can be a label to indicate the color with a two-dimensional (2D) image using a decal. In the configuration shown in the drawings, the projecting portion 75 (on the proximal side of the finger hook face 76) is substantially rectangular and projects from the front face of the container body 31A outward (to the proximal side). In this case, the front side of the projecting portion 75 (on the back of the finger hook face 76) can be produced by monolithic molding with the front side ribs 72*a* disposed dense for reinforcement and provide the decal bonding mount for the decal 78. Thus, the cost of the mold can be reduced. When the color of toner is indicated by bonding the decal 78, common toner containers 31 can be used for different color toners, thus reducing the cost and the management work of components. Projecting outward the decal bonding mount of the handle 72 is also advantageous in enhancing the design flexibility of the projecting portion 74 projecting inward on the back of the decal bonding mount. Accordingly, even when upper sloped faces 742 (shown in FIG. 5C) are added on the lateral sides (different from proximal and distal sides) of the projecting portion 74 to facilitate downward movement of toner, it does not affect the decal outer shape, and the decal bonding mount can keep the rectangular shape without reducing the capacity.

The portion of the handle 72 projecting from the front face of the container body 31A is rectangular, an upper face 725 of the projecting portion can be horizontal, and a thumb of the user can be hooked thereon. Thus, the user can grasp the handle 72 firmly.

Since the proximal end of the finger hook face 76 of the handle 72 is on the proximal side of (upstream in the insertion direction A from) the back face (inner face) of the cover 34, the interference therebetween can be avoided, and the capacity of the container body 31A can be secured.

Next, with reference to FIGS. 7A, 7B, and 8, descriptions are given of the rotatable agitator 32 that rotates around a rigid shaft 32B inside the container body 31A to agitate toner. The rigid shaft 32B is parallel to the conveying screw 33 in the vertical direction.

An inner bottom wall of the container body 31A is circular in conformity with the orbit of rotation of the rotatable agitator 32. The rotatable agitator 32 agitates toner inside the container body 31A and transports toner to the conveying screw 33. The rotatable agitator 32 includes the rigid shaft 32B, a rigid bone 32A produced by monolithic molding with the rigid shaft 32B, and flexible blades 32C at an end of the rigid bone 32A. The rigid bone 32A and the flexible blades 32C are designed to draw the orbit of rotation around the rigid shaft 32B. The rigid bone 32A projects symmetrically to both sides from the rigid shaft 32B in a direction perpendicular to the axis of the rigid shaft 32B, and the rotatable agitator 32 has a two-blade structure with the flexible blade 32C positioned at an interval of 180 degrees.

Alternatively, the rotatable agitator 32 may have a single-blade structure in which the rigid bone 32A projects only to one side of the rigid shaft 32B. Additionally, openings 32E are provided in the rigid bone 32A to allow passage of toner. Further, a joint 32D is provided at the end of the rigid shaft 32B, and a joint 33D is provided an end of a rigid shaft 33B of the conveying screw 33 (shown in FIG. 7B). The length of the flexible blade 32C can be set so that an outer end (in the diameter direction) thereof contacts the inner bottom wall of the container body 31A during the rotation.

With this configuration, the rotatable agitator 32 can rotate with the end of the flexible blade 32C in contact with the inner bottom wall of the container body 31A and scrape off toner from the inner bottom wall. Thus, the amount of toner remaining thereon can be reduced.

It is to be noted that, as shown in FIG. 3, the toner container 31K for black has a capacity greater than that of other toner containers 31Y, 31C, and 31M, and the container body 31A for containing black toner is increased in lateral size from those for other color toners. Inside the toner container 31K, two blades (right and left blades) that rotate without interfering with each other are provided. This configuration can facilitate both accommodation of the greater amount of black toner and agitation thereof.

As shown in FIG. 7B, it is preferred that the rigid shaft 32B and the rigid bone 32A be formed monolithic with metal, resin, or the like. However, the material and the production method thereof are not limited thereto. Examples of the material of the flexible blade 32C can be flexible materials having a lower rigidity, such as polyethylene terephthalate (PET), polyethylene (PE), polypropylene (PP), polyphenylene sulfide (PPS), and polyurethane sheets. The thickness is preferably from about 50 μm to about 500 μm, and more preferably from about 50 μm to 300 μm. When the flexible blade 32C is flexible, the rotatable agitator 32 is not inhibited from rotating even when the end of the flexible blade 32C is in contact with the inner bottom face of the toner container 31.

As shown in FIG. 7B, the rotatable agitator 32 and the conveying screw 33 are parallel and face each other in the vertical direction in the toner container 31. The conveying screw 33, which is provided on the container bottom to supply toner from the toner outlet 50 to the developing device 102, is disposed outside the orbit of rotation of the rotatable agitator 32 to avoid the interference therewith. With this arrangement, the outer bottom face of the container body 31A includes a downward projection, that is, the groove 311 (shown in FIGS. 6A and 6B), and the groove 311 has a capability to transport toner to the toner outlet 50.

The toner inside the toner container 31 is agitated by the rotatable agitator 32 and transported conveying screw 33.

The conveying screw 33 transports toner via the toner outlet 50 (shown in FIG. 7B) to a sub-hopper or to the developing device 102 positioned beneath the developing device 102.

A driving unit for the rotatable agitator 32 and the conveying screw 33 is provided to the rear wall 385 of the toner container 31.

The driving unit includes an upper driving shaft 65 facing the rotatable agitator 32 and a lower driving shaft 67 facing the conveying screw 33, and a driving end of the driving unit includes a claw 66 monolithic with the upper driving shaft 65 and a claw 68 monolithic with the lower driving shaft 67, which are pivotally supported on the side of the rear wall 385.

The claw 66 of the upper driving shaft 65 can engage the joint 32D at the end of the rigid shaft 32B of the rotatable agitator 32.

The claw 68 of the lower driving shaft 67 can engage the joint 33D at the end of the rigid shaft 33B of the conveying screw 33 (shown in FIG. 7B).

Simultaneously with installation of the toner container 31 into the container mount 38 of the apparatus body 1, the claw 66 engages the joint 32D and the claw 68 engages the joint 33D. Then, the upper driving shaft 65 can rotate the rotatable agitator 32 via the rigid shaft 32B, and toner can be agitated by the rotatable agitator 32. Additionally, the lower driving shaft 67 can drive the conveying screw 33 via the rigid shaft 33B, and toner can be moved to the toner outlet 50 and flow down therefrom.

A structure to open and close the toner outlet 50 is described below.

The groove 311 projecting downward from the bottom of the toner container 31 extends long in the insertion direction A, and the rectangular toner outlet 50 is positioned downstream from the groove 311 in the insertion direction A and faces down. The toner outlet 50 is opened and closed by the shutter 51. The shutter 51 includes a rectangular body 511, flexural guides 512 on right and left sides of the body 511, elastic pieces 513 that are respectively parts of the flexural guides 512, and latch portions 514 at ends of the elastic pieces 513.

The right and left latch portions 514 elastically and slidably engage right and left rail grooves 312 (in FIG. 7A, only one of them is shown) of the groove 311, and the body 511 can slide in the insertion direction A being kept in contact with a lower face of a wall constituting the groove 311. Additionally, the position of the body 511 that slidably contacts the lower face of the wall of the groove 311 can be switched between the closing position P1 to close the toner outlet 50 and the open position P2 to open the toner outlet 50. The body 511 is urged by a bias member such as a spring to the closing position P1.

Referring to FIG. 8, in the state in which the toner container 31 is inserted into the insertion entrance 381 and fitted in the container mount 38, the shutter 51 is at the closing position P1 and the leading end of the shutter 51 (in the insertion direction A) abuts against the stopper face fs that is the wall of the table portion 63. Then, as shown in FIG. 8, the shutter 51 moves from the closing position P1 to the open position P2 against the elastic force of the spring, thereby opening the toner outlet 50, and a contact portion 631 (facing up) of the table portion 63 closely contacts the periphery of the toner outlet 50. Then, toner flowing to a downward toner channel 632 of the contact portion 631 is further transported to the sub-hopper or the developing device 102 disposed beneath the container body 31A.

It is to be noted that, when the toner container 31 is pulled out from the container mount 38, the leading end of the shutter 51 leaves the stopper face fs of the table portion 63, and the shutter 51 returns to the closing position P1 due to the elastic force exerted by the spring. Thus, the toner container 31 is closed from the outside, preventing leak of toner.

The above-described image forming apparatus 100 can inhibit the component, such as the shutter 51, on the bottom of the toner container 31 from hitting against the bottom wall 383 of the entrance peripheral wall FR surrounding the insertion entrance 381 and thus can inhibit malfunction caused thereby.

Additionally, even when the depth of the toner container 31 (length in the insertion direction A) is smaller than the width of the toner container 31 (length in the direction perpendicular to the insertion direction A), the toner container 31 can be easily inserted into the insertion entrance 381. Additionally, since the color of toner of the toner container 31 to be inserted is indicated on the bottom wall 383 at the periphery of the insertion entrance 381, insertion of a wrong toner container 31 can be inhibited.

Figure 6A:
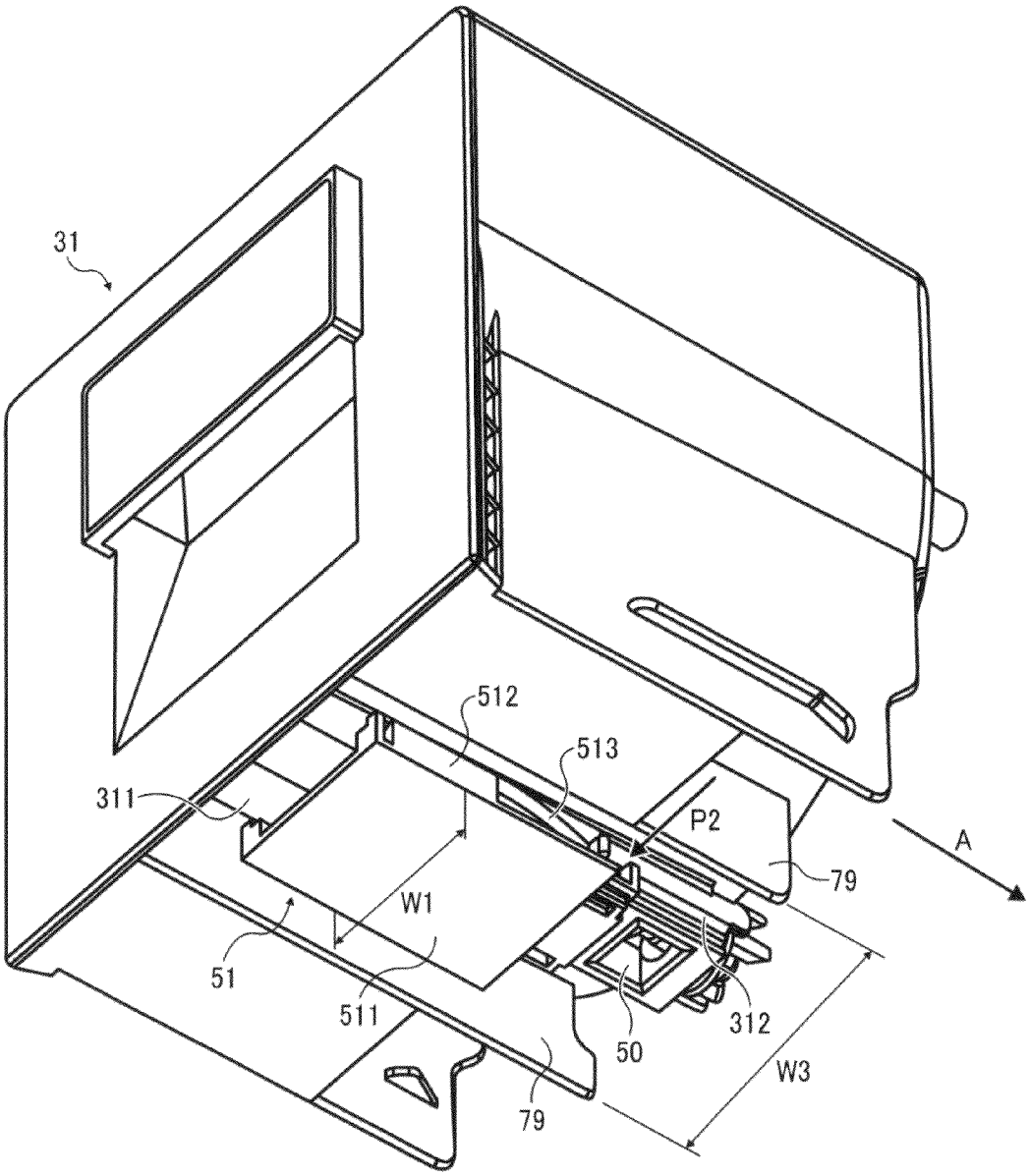
FIGS. 6A and 6B are perspective views from a bottom of the toner container shown in FIGS. 5A through 5D, in which a shutter is open and closed, respectively.
Figure 6B:
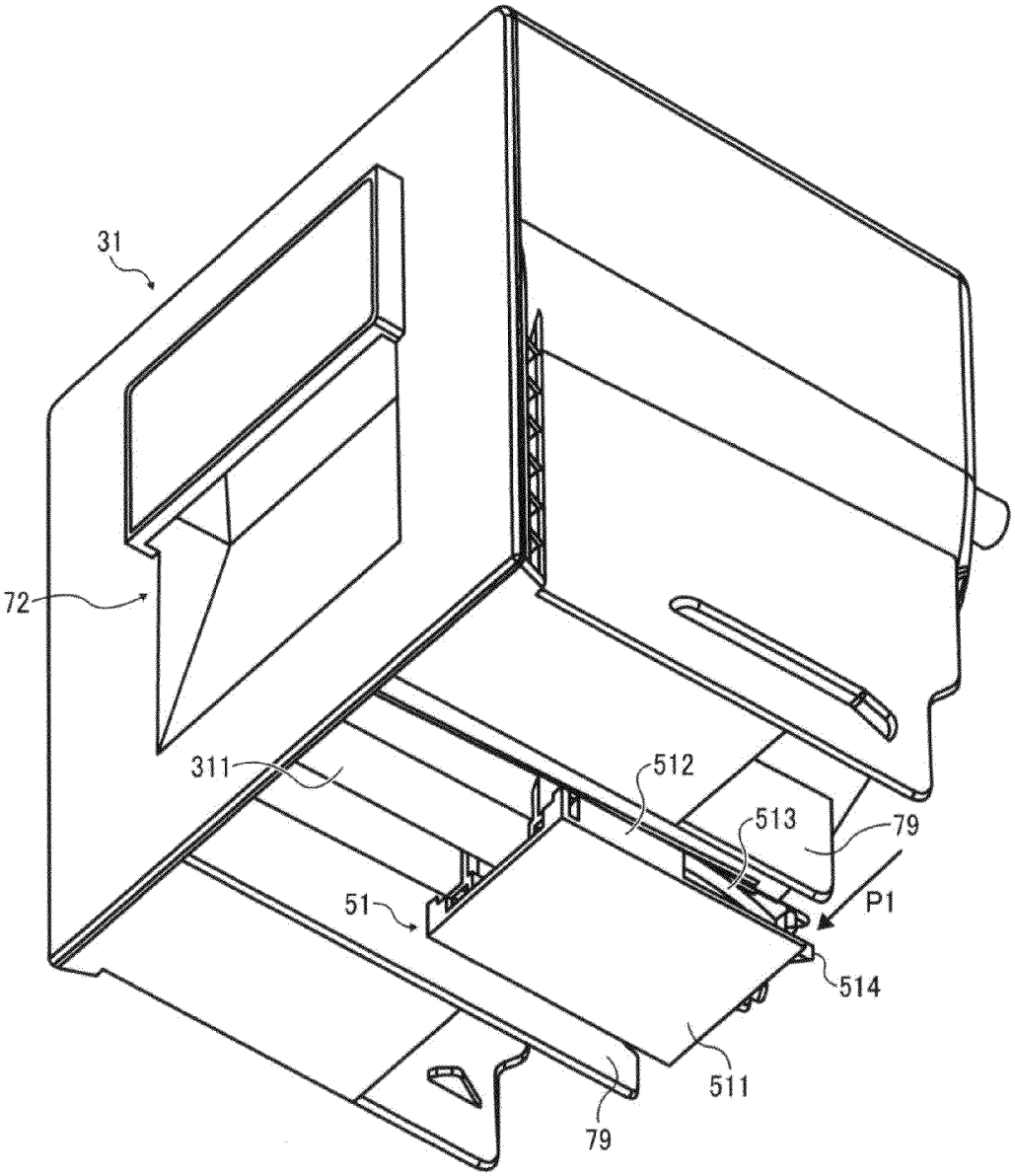

Additionally, referring to FIGS. 6A and 6B, a pair of plates 79 extends downward from the bottom of the toner container 31. The plates 79 are arranged in the lateral direction (i.e., width direction) of the shutter 51 (perpendicular to the insertion direction A) and extend in the insertion direction A. In the configuration shown in FIGS. 6A and 6B, the shutter being at the closing position P1 is on the leading side in the insertion direction A.

A downstream end face of the plate 79 in the insertion direction A projects downward beyond a downstream end face of the shutter 51. The plates 79 stand at a distance W3 from each other with the shutter 51 interposed therebetween. The distance W3 is greater than the length W2 (width) of the recess 61. Accordingly, after the plates 79 of the toner container 31 are placed on the projecting portion of the bottom wall 383 (i.e., the projecting bottom wall projecting more than the upper wall 382), the position of the toner container 31 can be easily adjusted, after which the toner container 31 is inserted further in the insertion direction A. While this operation, interference between the shutter 51 and the projecting bottom wall can be inhibited by the recess 61. This configuration is effective, for example, in inhibiting the risk of hitting the shutter 51 on the bottom wall 383 and unintentionally opening the shutter 51.

According to the embodiment described above, the center portion of the projecting bottom wall is recessed. Accordingly, while the position of the leading bottom of the toner container 31 in the insertion direction A is determined, a component, such as the shutter 51, provided to the leading bottom can be inhibited from hitting against the projecting bottom wall and from opening before completion of insertion of the toner container 31.

It is to be noted that the various aspects of the present specification can adapt to, not limited to the printer described above, other types of image forming apparatuses such as multicolor copiers, fax machines, and scanners.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a toner container to contain toner;

an insertion entrance through which the toner container is inserted; and an entrance peripheral wall surrounding the insertion entrance and including an upper wall and a projecting bottom wall projecting beyond the upper wall to an upstream side in an insertion direction in which the toner container is inserted, wherein the toner container includes a toner outlet in a substantially center portion of a bottom of the toner container in a width direction perpendicular to the insertion direction and a shutter to open and close the toner outlet, a recess is provided in a center portion of the projecting bottom wall in the width direction and recessed from the upstream side to a downstream side in the insertion direction, the recess is longer than the shutter in the width direction, and the recess and the toner outlet are linearly arranged along the insertion direction.

2. The image forming apparatus according to claim 1, wherein a length of the toner container in the insertion direction is smaller than a length of the toner container in the width direction, and the toner container further comprises a handle disposed on the upstream side in the insertion direction.

3. The image forming apparatus according to claim 1, further comprising a color indication provided to the projecting bottom wall, the color indication adjacent to the recess of the projecting bottom wall.

4. The image forming apparatus according to claim 1, wherein the toner container further comprises a pair of plates projecting from the bottom of the toner container and extending in the insertion direction, the plates positioned across the shutter from each other in the width direction, and a distance between the plates is greater than the recess in the width direction.

5. An image forming apparatus comprising:

a toner container to contain toner;

an insertion entrance through which the toner container is inserted; and an entrance peripheral wall surrounding the insertion entrance and including an upper wall and a projecting bottom wall projecting beyond the upper wall to an upstream side in an insertion direction in which the toner container is inserted, wherein the toner container includes a toner outlet in a substantially center portion of a bottom of the toner container in a width direction perpendicular to the insertion direction and a shutter to open and close the toner outlet, a recess is provided in a center portion of the projecting bottom wall in the width direction and recessed from the upstream side to a downstream side in the insertion direction, and the recess is longer than the shutter in the width direction, wherein the toner container further comprises a pair of plates projecting from the bottom of the toner container and extending in the insertion direction, the plates positioned across the shutter from each other in the width direction, and wherein a distance between the plates is greater than the recess in the width direction.

6. The image forming apparatus according to claim 5, wherein a length of the toner container in the insertion direction is smaller than a length of the toner container in the width direction, and the toner container further comprises a handle disposed on the upstream side in the insertion direction.

7. The image forming apparatus according to claim 5, further comprising a color indication provided to the projecting bottom wall, the color indication adjacent to the recess of the projecting bottom wall.

* * * * *